United States Patent [19]

Walter et al.

[11] Patent Number: 4,778,412

[45] Date of Patent: Oct. 18, 1988

[54] BUSS BAR ASSEMBLIES

[75] Inventors: Gerard S. Walter, Glenshaw; John Hagen, Gibsonia, both of Pa.

[73] Assignee: Walter Electrical Manufacturing Company, Pittsburgh, Pa.

[21] Appl. No.: 31,259

[22] Filed: Mar. 27, 1987

[51] Int. Cl.[4] ..... H01R 13/11

[52] U.S. Cl. ..... 439/798

[58] Field of Search ..... 439/207, 209, 210, 715, 439/716, 721, 784, 786, 787, 796–798, 801, 805, 807, 810–812, 814

[56] References Cited

U.S. PATENT DOCUMENTS

| | | | |
|---|---|---|---|
| 1,913,552 | 6/1933 | Jackson | 174/72 C |
| 1,926,927 | 9/1933 | Woertz | 439/716 |
| 2,232,602 | 2/1941 | Grace | 173/324 |
| 2,288,941 | 7/1942 | Curtis | 240/78 |
| 2,290,691 | 7/1942 | Lemont | 24/243 |
| 2,569,223 | 9/1951 | Bowers | 173/324 |
| 3,047,835 | 7/1962 | Kelly | 339/242 |
| 3,210,716 | 10/1965 | Meacham | 439/117 |
| 3,335,399 | 8/1967 | Rys | 339/219 |
| 3,425,022 | 1/1969 | Walter et al. | 339/22 |
| 3,551,876 | 12/1970 | Walter | 339/21 |
| 3,727,171 | 4/1973 | Coles et al. | 439/796 |
| 4,231,633 | 11/1980 | Luke et al. | 439/798 |
| 4,500,161 | 2/1985 | Keglewitsch et al. | 439/798 |
| 4,640,571 | 2/1987 | Walter et al. | 439/798 |

FOREIGN PATENT DOCUMENTS

| | | |
|---|---|---|
| 736704 | 6/1943 | Fed. Rep. of Germany . |
| 888909 | 12/1943 | France . |
| 692707 | 6/1953 | United Kingdom . |

*Primary Examiner*—Gil Weidenfeld
*Assistant Examiner*—Paula A. Austin
*Attorney, Agent, or Firm*—Michael L. Dever; Buchanan Ingersoll

[57] ABSTRACT

An electrical buss bar assembly is provided in which an elongate conductor member having at least one generally flat surface with two spaced generally parallel channels having an opening through the flat surface narrower than a major section of the channel parallel to the flat surface and separated by a riser member extending above said surface are provided with at least one connector module made up of a top member with two depending legs bent inwardly at the end remote from the top member and terminating adjacent the riser member and having a foot member on each slidably engaged in the parallel channels through said opening, and clamp means in the top member acting to exert pressure on a wire inserted between the legs and on the riser to fix the wire in the connector module and the connector module in tight conductive relation on the conductor member.

4 Claims, 1 Drawing Sheet

BUSS BAR ASSEMBLIES

The present invention relates to buss bar assemblies and particularly to a buss bar assembly which can be as long as necessary and provides modules which may take different sizes and be connected to an elongated conductor to form a single integral unit.

In the past it has been the practice to connect heavy conductors to a buss bar using wire clamps with a screw type clamp to apply connecting pressure to the conductor. Typical of such prior art connectors are those illustrated in U.S. Pat. Nos. 1,913,552; 2,232,602; 2,288,941; 2,290,691; 2,569,223; 3,047,835; 3,335,399, earlier Walter Pat. No. 3,425,022 and 3,551,876 and in French Pat. No. 888,909; British Pat. No. 692,707 and German Pat. No. 736,704. Those earlier patents, while excellent for their time and purpose were limited in number and variety of wire connections that they could be used to make and were difficult to assemble to a buss bar.

We have invented a buss bar assembly which can connect large numbers of wires to a single buss bar using single and double connector modules, each of which is readily movable and spaced along the length of the buss bar and fixed in position as the wires are compressed and connected in the connector modules. Such as assembly has particular utility in large buildings where large numbers of wires must be connected.

We provide an electrical buss bar assembly comprising an elongate conductor member having a generally flat top surface with two spaced parallel channels extending lengthwise of the conductor and separated by a vertical riser forming an integral part of the conductor and extending above the top surface of the conductor member and forming adjacent walls of the spaced channels, at least one wall of each channel extending upwardly and inwardly from the bottom of the channel at an angle to form an opening smaller in width than the bottom of the channel, at least one connector module adapted to receive at least one wire slidable in said channels, said connector module having a top member and two depending legs at each side, each leg having a depending foot member opposite the top member with a cross section corresponding to one of the channels in the conductor member and slidable therein, said depending foot members being separated to receive the vertical riser therebetween, a screw member threaded in said top member extending between the legs and a clamp member pivoted on the end of the screw member between the depending legs for clamping a wire between the clamp member, the riser and at least a part of the depending legs to clamp the wire and to cause the connector module to be forced upwardly to frictionally engage the depending foot members in the two spaced channels of the elongate conductor member. Preferably each leg is turned inwardly at the end opposite the top member and provided with a depending foot member. The top member of the connector member may be provided with a channel extending transversely thereof intermediate the legs and parallel thereto and having the stem of a generally T shaped member slidable therein, said head having curved surfaces on each side of the stem and on the top cooperating with curved surfaces in the depending legs, said top contacting the top of the vertical riser, and at least one screw member threaded in said top member between each leg and the stem of the T shaped member and carrying a clamp member pivoted thereon between each depending leg and the stem of the T shaped member. Preferably the elongate conductor member is extruded aluminum.

In the foregoing general description we have set out certain objects, purposes and advantages of this invention. Other objects, purposes and advantages of the invention will be apparent from a consideration of the following description and the accompanying drawings in which.

Figure 1:
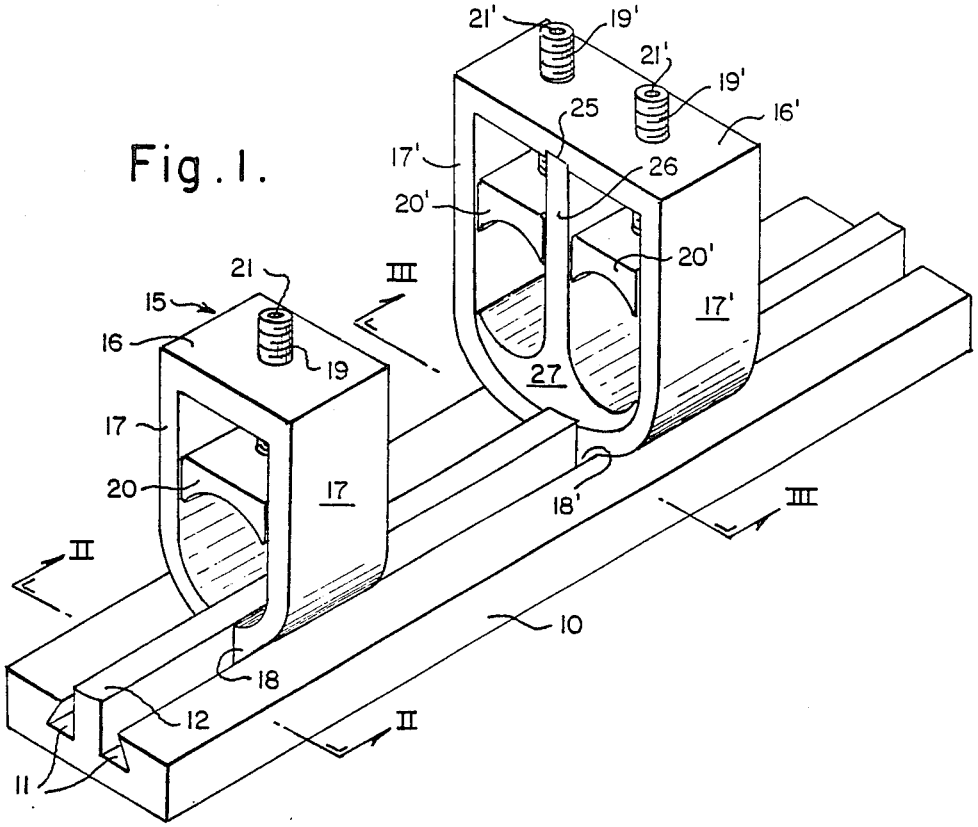
FIG. 1 is an isometric view of a segment of buss bar and connector assembly according to this invention.

Referring to the drawings I have illustrated a buss bar 10 in the form of an elongate conductor of generally rectangular shape with a pair of channels 11 separated by an integral riser 12 extending the full length of the conductor. One wall of each channel 11 extends upwardly and inwardly toward the riser at an angle to form an opening at the top smaller than the bottom of the channel. These channels are adapted to receive connector modules 15, such as that illustrated in FIG. 2, made up of a top member 16 and two depending generally parallel legs 17 which are curved inwardly toward riser 12 and provided with a foot member 18 having a section generally corresponding to channels 11 and adapted to slide in said channels. The riser 12 extends above the top of buss bar 10 between legs 17 and has a rounded top surface corresponding to the contour of the curved ends of legs 17. A screw member 19 is threaded through top member 16 of the connector member. Each screw member 19 is fitted at the end extending into the area between legs 17 with a pivoted clamp member 20 slidable between legs 17. The other end of screw member 19 is provided with a drive connection such as a hexagonal hole 21.

In operation, a wire is inserted between the top of riser 12 and clamp member 20, the screw 19 is turned to move clamp member 20 toward the wire which is compressed against the top of riser 12 and the legs 17 of the connector member. This causes the connector member to move upwardly relatively to buss bar 10, viewing FIG. 1, which wedges the foot members 18 into tight engagement with the walls of channel 11 thereby fixing the connector member against movement and providing a tight conductive connection between the buss bar 10 and connector member 15.

Figure 3:
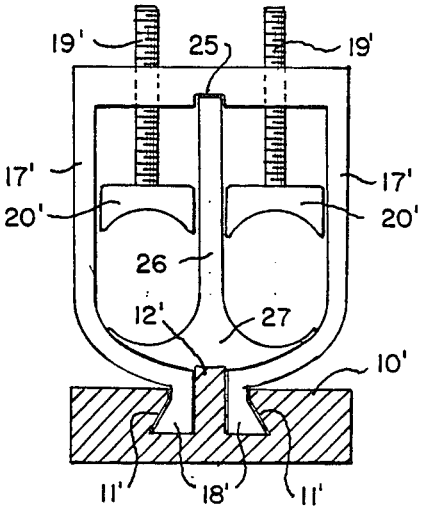
FIG. 3 is a section on the line III—III of FIG. 2.

In FIG. 3 there is illustrated another form of connector module in which like parts bear like reference numerals with a prime sign. In this form of connector module, the top member 16' is provided with a groove 25 extending intermediate and parallel to legs 17'. The end of stem 26 of a generally T shaped member is slidably engaged in this groove 25. The head 27 of the generally T shaped member is of crescent shape and slidably engages the head of riser 12' and the inside curved walls of legs 17'. A screw member 19'is provided in the head member 16' intermediate stem 26 and each leg 17' and is fitted with a pivoted clamp member 20'.

Figure 2:
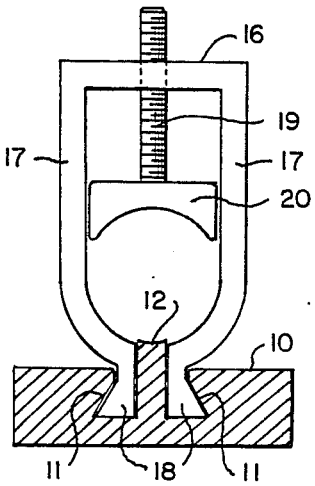
FIG. 2 is a section on the line II—II of FIG. 1.

In operation, the connector module of FIG. 3 is similar to that of FIG. 2. Wires are inserted between the head of the T and each clamp member 20' and screws 19' are turned to force the clamp member 20' against the wire which in turn puts pressure on head 27 of the T shaped member which there presses against the top of riser 12' forcing foot members 18' into tight engagement with channels 11' as the top member 16' is forced upwardly by screws 19'. This engages the wire tightly and fixes the connector module in place on buss bar 10' with a tight conductive contact.

In the foregoing specification certain preferred practices and embodiments of this invention have been set out, however, it will be understood that the invention may be otherwise embodied within the scope of the following claims.

We claim:

1. An electrical buss bar assembly comprising an elongate conductor member having a generally flat surface with two spaced parallel channels extending lengthwise thereof, a riser member extending above the flat surface of said conductor member between said channels and forming adjacent walls of each, at least one wall of each channel extending upwardly at an angle from the bottom of the channel to form an opening in the flat surface of the conductor member smaller in width than the bottom of the channel, at least one connector module having a top member and depending legs at each side, each leg having a depending foot member remote from the top member with a cross section corresponding to the cross section of the channels in the conductor member and slidable through the opening, said foot members being separated to receive the riser therebetween, a screw member threaded in the top member and extending between the legs and a clamp member pivoted on the end of the screw member between the depending legs for clamping a wire between the clamp member and riser and the depending legs where the connector module is forced away from the flat surface of the conductor member causing the foot members to tightly engage the channels, wherein the top member of the connector module has a groove intermediate and parallel to the legs, a generally T shaped member having a stem with a transverse head at one end, the other end of said stem being slidable in said groove and the head bearing on and slidable on the riser of the elongate member and on adjacent portions of said legs.

2. An electrical buss bar as claimed in claim 1 wherein the transverse head has a generally crescent shape.

3. An electrical buss bar assembly comprising an elongate conductor member having a generally flat surface with two spaced parallel channels extending lengthwise thereof, a riser member extending above the flat surface of said conductor member between said channels and forming adjacent walls of each, at least one wall of each channel extending upwardly at an angle from the bottom of the channel to form an opening in the flat surface of the conductor member smaller in width than the bottom of the channel, at least one connector module having a top member and depending legs at each side, wherein the legs extend in parallel relationship from the top member and are curved toward each other at the end remote from the top member, terminating adjacent the riser member, each leg having a depending foot member remote from the top member with a cross section corresponding to the cross section of the channels in the conductor member and slidable through the opening, said foot members being separated to receive the riser therebetween, a screw member threaded in the top member and extending between the legs and a clamp member pivoted on the end of the screw member between the depending legs for clamping a wire between the clamp member and riser and the depending legs where the connector module is forced away from the flat surface of the conductor member causing the foot members to tightly engage the channels, wherein the top member of the connector module has a groove intermediate and parallel to the legs, a generally T shaped member having a stem with a transverse head at one end, the other end of said stem being slidable in said groove and the head bearing on and slidable on the riser of the elongate member and on adjacent portions of said legs.

4. An electrical buss bar as claimed in claim 3 wherein the transverse head has a generally crescent shape.

* * * * *

UNITED STATES PATENT AND TRADEMARK OFFICE

CERTIFICATE OF CORRECTION

PATENT NO. : 4,778,412

DATED : Oct. 18, 1988

INVENTOR(S) : Gerard S. Walter and John Hagen

It is certified that error appears in the above-identified patent and that said Letters Patent are hereby corrected as shown below:

On the cover page, at [54], cancel "BUSS" and substitute -- BUS --.

In the ABSTRACT, line 1, cancel "buss" and substitute -- bus --.

Column 1, in the title, cancel "BUSS" and substitute -- BUS --.

Column 1, line 4, cancel "buss" and substitute -- bus --.
Column 1, line 5, cancel "buss" and substitute -- bus --.
Column 1, line 10, cancel "buss" and substitute -- bus --.
Column 1, line 20, cancel "buss" and substitute -- bus --.
Column 1, line 21, cancel "buss" and substitute -- bus --.
Column 1, line 22, cancel "buss" and substitute -- bus --.
Column 1, line 25, cancel "buss" and substitute -- bus --.
Column 1, line 29, cancel "buss" and substitute -- bus --.
Column 2, line 9, cancel "buss" and substitute -- bus --.
Column 2, line 13, cancel "buss" and substitute -- bus --.
Column 2, line 27, cancel "buss" and substitute -- bus --.
Column 2, line 41, cancel "buss" and substitute -- bus --.
Column 2, line 45, cancel "buss" and substitute -- bus --.
Column 3, line 1, cancel "buss" and substitute -- bus --.
Column 3, line 9, cancel "buss" and substitute -- bus --.
Column 4, line 1, cancel "buss" and substitute -- bus --.

UNITED STATES PATENT AND TRADEMARK OFFICE

CERTIFICATE OF CORRECTION

PATENT NO. : 4,778,412

DATED : October 18, 1988

INVENTOR(S) : Gerard S. Walter and John Hagen

It is certified that error appears in the above-identified patent and that said Letters Patent is hereby corrected as shown below:

Column 4, line 3, cancel "buss" and substitute -- bus --.
Column 4, line 37, cancel "buss" and substitute -- bus --.

Signed and Sealed this

Twentieth Day of June, 1989

*Attest:*

*Attesting Officer*

DONALD J. QUIGG

*Commissioner of Patents and Trademarks*